United States Patent [19]

Wirtz et al.

[11] 4,422,923

[45] Dec. 27, 1983

[54] PROCESS FOR RECOVERING SOLVENTS FROM SOLVENT-CONTAINING HYDROCARBON PHASES IN HYDROCARBON RAFFINATION SYSTEMS

[75] Inventors: Gerhard Wirtz, Frankfurt; Rainer Maxelon, Raunheim, both of Fed. Rep. of Germany

[73] Assignee: Edeleanu Gesellschaft mbH, Frankfurt, Fed. Rep. of Germany

[21] Appl. No.: 226,415

[22] Filed: Jan. 19, 1981

[30] Foreign Application Priority Data

Jan. 29, 1980 [DE] Fed. Rep. of Germany ..... 3002984

[51] Int. Cl.[3] ..... C10G 21/28

[52] U.S. Cl. ..... 208/33; 208/321

[58] Field of Search ..... 208/33, 321, 326, 327, 208/335

[56] References Cited

U.S. PATENT DOCUMENTS

| | | | |
|---|---|---|---|
| 2,806,071 | 9/1957 | Findlay | 260/674 |
| 2,866,689 | 12/1958 | Samuels | 23/209.1 |
| 2,885,356 | 5/1959 | Fisher | 208/361 |
| 3,470,089 | 9/1969 | Morris et al. | 208/326 |
| 4,052,294 | 12/1977 | Blume et al. | 208/33 |

*Primary Examiner*—G. L. Kaplan
*Assistant Examiner*—William Leader
*Attorney, Agent, or Firm*—Carl G. Ries; Robert A. Kulason; Robert Knox

[57] ABSTRACT

Recovery of solvent from hydrocarbon oil extract fractions comprising solvent and oil is effected in at least three sequential flash vaporization stages wherein the pressure of the second vaporization stage is at the highest pressure level and the pressure of the third vaporization stage is at a pressure level intermediate the pressure level of the first and second vaporization stages.

5 Claims, 2 Drawing Figures

Figure 1:
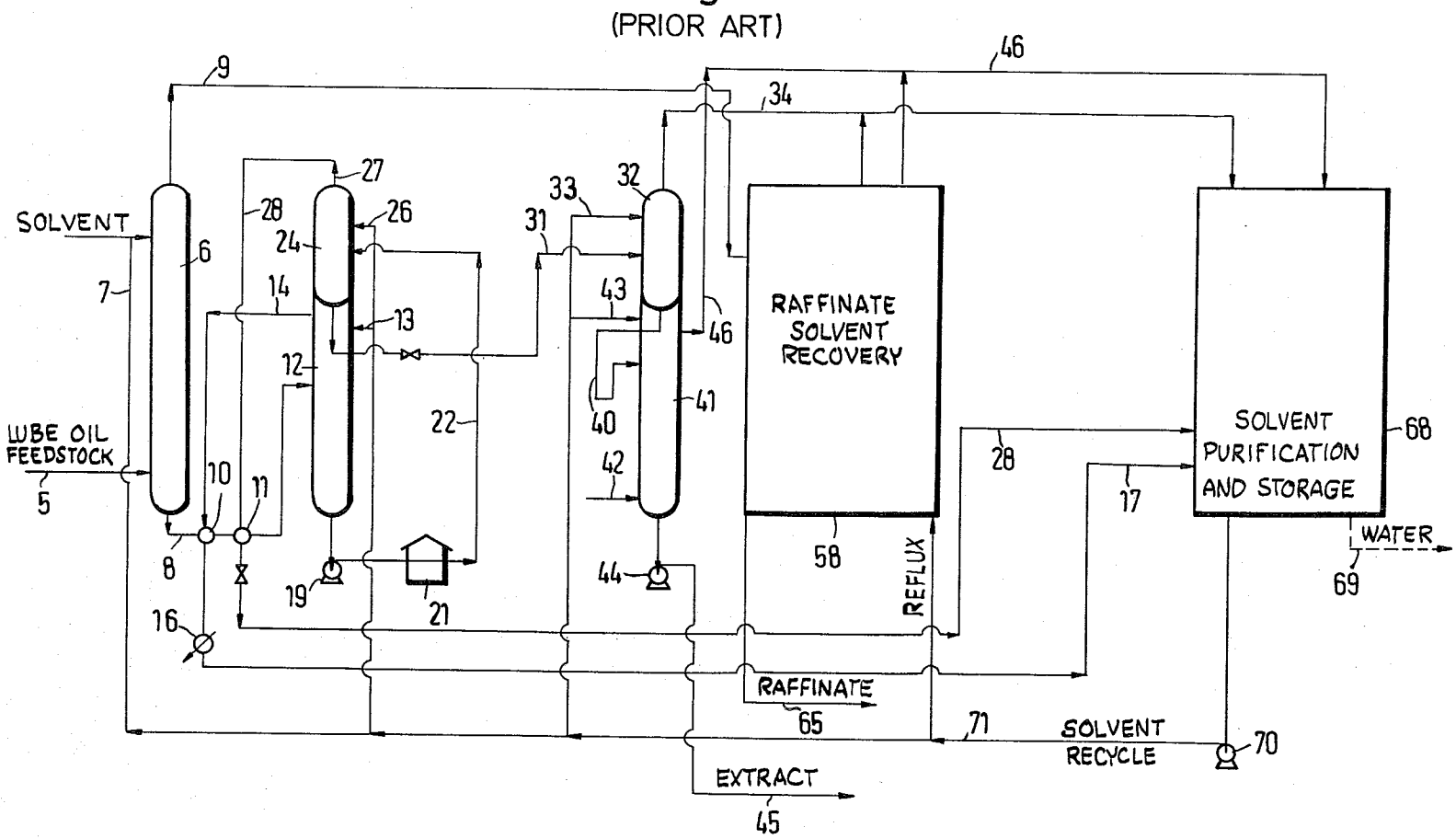
Fig.1 (PRIOR ART)

PROCESS FOR RECOVERING SOLVENTS FROM SOLVENT-CONTAINING HYDROCARBON PHASES IN HYDROCARBON RAFFINATION SYSTEMS

The invention relates to the recovery of solvents from a mixture of hydrocarbons and solvents.

In the working up of mineral oils processes are known for treating mixtures of hydrocarbons with selective solvents, for example in dewaxing by means of solvents and in the extractive separation of the components of mixtures of hydrocarbons.

By such treatment mixtures are being formed which contain larger or smaller quantities of solvent used. This solvent must be recovered in order to keep as low as possible the loss of solvent from the process.

The following description refers especially to the solvent extraction of mineral oils.

In the field of such extractions, e.g. of lubricating oils, a number of solvents are known which have an affinity for at least one component of a mixed base lubricating oil charge stock and which, however, are immiscible with parts of the lubricating oil charge stock under conditions of the oil-solvent contacting zone.

The two liquid phases in the contacting zone generally consist essentially of an extract phase containing a major amount of the solvent together with dissolved components of the charge stock and a raffinate phase containing undissolved components of the charge stock together with minor amounts of solvent.

Particularly preferred solvents are furfural and N-methyl-2-pyrrolidone because of their chamical stability, low toxicity and their ability to produce refined oils of improved quality. They are effective for the solvent extraction of aromatic components from lubricating oil charge stocks at relatively low temperatures and low solvent to oil dosages.

Various methods are employed for the separation and recovery of solvent from the extract and raffinate mixtures, the exact nature of the recovery system depending to some extent upon the nature of the solvent, for example whether the solvent is furfural, N-methyl-2-pyrrolidone, phenol, or a mixture of such solvents and whether the solvent also contains water as a moderator.

It now has been found that in recovering solvent such as a hydrocarbon extraction solvent, e.g. furfural or N-methyl-2-pyrrolidone from an extract phase wherein said solvent is separated from said extract by flash vaporization in two successive separation zones at different pressures, that the introduction of an intermediate pressure separation zone in the separation system in the manner hereinafter described, surprisingly effects an essential saving of energy. That is to say that the inventive vaporization of the solvent from the hydrocarbon phase in at least three separation stages in series as disclosed herein, results in a savings in energy of the order of 30 to 35 percent as compared with the known recovery of the solvent by flash vaporization in two stages, i.e. a low pressure flash tower and a high pressure flash tower. In other words, about one third less energy is required for conducting the vaporization in three pressure stages in accordance with this invention than is required for effecting the same separation in two pressure stages as in current practice.

The invention is defined in claim 1.

The process of this invention is particularly adaptable to existing furfural, N-methyl-2-pyrrolidone, and phenol refining installations. It is also adaptable in the solvent recovery of dewaxing installations which separates wax and oil under application of solvents.

Details of the invention will be evident from the accompanying drawings and the following detailed description of the process of this invention as compared with an illustrative conventional solvent refining operation.

FIG. 1 of the drawings is a simplified schematic flow diagram illustrating a conventional solvent refining process.

Figure 2:
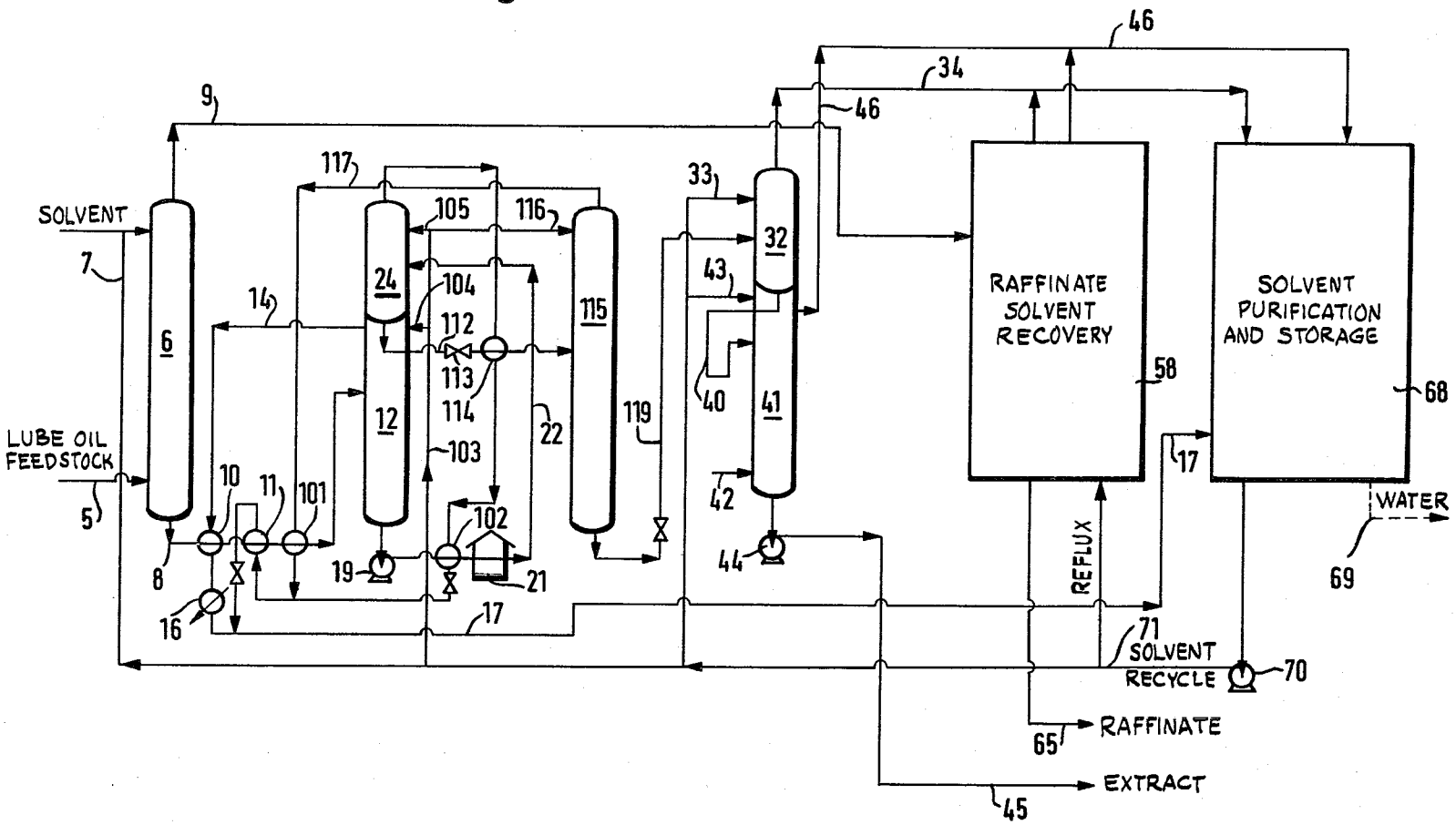

FIG. 2 of the drawings is a schematic flow diagram illustrating a solvent refining process employing a modified solvent recovery operation in accordance with the process of this invention.

With reference to FIG. 1 of the drawings, lubricating oil feedstock is introduced through line 5 to an extraction tower 6 where it is intimately countercurrently contacted with solvent entering the upper portion of extraction tower 6 through line 7. Feed for tower 6 are e.g. lubricating oil and a selective solvent such as furfural or N-methyl-2-pyrrolidone. An extract mixture comprising about 85 percent solvent is withdrawn from the bottom of extraction tower 6 through line 8. The system illustrated is typical of commercial furfural refining processes. The process of this invention is applicable to other solvent refining processes as well.

The raffinate mixture comprising typically 85 percent hydrocarbon oil admixed with solvent is discharged from the extraction tower 6 through line 9 and processed for the recovery of raffinate from the solvent as described hereafter. The raffinate, after the separation of solvent is the solvent refined lubricating oil base stock, i.e. the desired product of the process.

Various methods are employed for the separation and recovery of solvent from the extract and raffinate mixtures, the exact nature of the recovery system depending to some extent upon the nature of the solvent, for example whether the solvent is furfural, N-methyl-2-pyrrolidone, phenol, or a mixture of such solvents and whether the solvent also contains water as a moderator. In a typical process illustrated in FIG. 1, the raffinate is recovered by vaporizing the solvent in a vacuum flash separation followed by stripping the raffinate with steam or an inert gas. When steam is employed as a stripping medium, water must be removed from the solvent prior to re-use in the process; with furfural as a solvent, this usually involves a combination of liquid phase azeotrope separation and two column fractional distillation.

The major portion of the solvent appears in the extract mixture withdrawn from the bottom of extraction tower 6 through line 8. The extract mixture is processed first for the recovery of solvent from the extract and then for recovery of the extract as a marketable product of the process.

The extract mixture is withdrawn from the bottom of extraction tower 6 through line 8 and passed in succession through heat exchangers 10 and 11 which serve to preheat the extract mixture and to vaporize the solvent partly and is introduced into low pressure flash tower 12, suitably maintained at a pressure in the range of 0.1 to 1 bar wherein solvent vapors are separated from the extract mixture. Solvent is introduced into the upper part of tower 12 as reflux through line 13. Solvent vapors separated from the extract flash tower 12 is discharged through line 14 to heat exchanger 10 wherein it is partly condensed by indirect heat exchange with cold extract mixture from extraction tower 6 thereby preheating the extract mixture prior to introduction to flash tower 12. The solvent is further condensed in cooler 16 and passed through line 17 to solvent purification and storage system 68.

Extract mixture, from which part of the solvent has been removed, is withdrawn from the bottom of flash tower 12 by pump 19 and passed through heater 21 to high pressure flash tower 24 via line 22.

A further amount of solvent is separated from the extract in high pressure flash tower 24 suitably maintained at a higher pressure. Solvent is introduced into the upper part of tower 24 as reflux through line 26.

Solvent vapors from flash tower 24 are passed through heat exchanger 11 via line 27 for indirect heat exchange with extract mixture from the bottom of extraction tower 6, the heat exchange serving to condense the solvent vapors and heat the extract mixture above the boiling point. Following the condensation and cooling of the solvent vapors by heat exchange, the condensed solvent is passed through line 28 to solvent purification and storage system 68 for re-use in the process.

The hydrocarbon oil extract, still containing some solvent is withdrawn from the bottom of high pressure flash tower 24 through line 31 to the extract recovery system comprising vacuum flash tower 32. Solvent is introduced into the upper part of the tower 32 as reflux through line 33.

Extract from the lower portion of vacuum tower 32 is passed through line 40 to stripper 41 wherein it is stripped of its final traces of solvent by means of inert gas or steam. Solvent is introduced near the top of stripping column 41 through line 43 as reflux. The stripped extract, containing less than about 50 parts per million solvent, e.g. furfural, N-methyl-2-pyrrolidone, or phenol, is withdrawn from the bottom of stripper 41 and discharged from the system by pump 44 through line 45 as a product of the process.

Stripping medium and solvent vapors are discharged from the upper part of stripping column 41 through line 46 and passed to solvent purification and storage system 68.

Raffinate mixture taken overhead from extraction tower 6 via line 9 is passed to raffinate solvent recovery 58 comprising of a vacuum flash tower and a raffinate stripper.

Solvent vapors separated from the raffinate mixture in the flash tower of system 58 are passed together with the solvent vapors from the top of vacuum flash tower 32 to solvent purification and storage system 68 through line 34.

Solvent and strip gas vapours from the raffinate stripper of system 58 is taken overhead through line 46 and passed together with overheads from extract stripper 41 to solvent purification and storage system 68. It will be evident from a comparison of FIGS. 1 and 2 above that the process of the conventional design requires a considerable higher amount of heating energy.

Each of both flash towers 12 and 24 in FIG. 1 will separate approx. ½ solvent vapours of the total solvent contained in the extract mixture from the bottom of the extractor 6 neglecting the small amount of solvent recovered in the vacuum flash tower 32 and the stripper 41.

Heater 21, as the only heat supply source, transfers heat to the extract mixture from the bottom of flash tower 12 and serves to evaporate ½ of the total solvent at elevated pressure.

The solvent portions as indicated above are only for understanding the principles of the double effect solvent recovery by re-use of the solvent vapor heat. They differ slightly since they do not consider the difference in condensing or evaporation heat at low and high pressure and they neglect the solvent left in the bottom of high pressure flash tower 24.

The condensing heat of the high pressure vapours is transferred by exchanger 11 to the extract mixture from the bottom of extractor 6 containing the total solvent. The condensing heat is used in exchanger 11 to preheat and to evaporate ½ of the total solvent of the extract mixture.

The driving force of the evaporation is the positive temperature difference between the condensing vapours from the flash tower 24 at high pressure and the flash temperature of the extract mixture entering the flash tower 12 at low pressure.

However, part of the low pressure vapours are condensed by preheating the extract mix from the bottom of extractor 6 by heat exchanger 10 to a temperature suitable below the boiling temperature of the extract mixture at the pressure in flash tower 12. The degree of condensing of the low pressure vapours depends on the temperature of the extract mix leaving extraction 6.

The low pressure vapours will be finally condensed in cooler 16.

Heater 21 in FIG. 1 has to evaporate approximately half of the total solvent contained originally in the extract mixture. This is the normal heat duty required according to the conventional solvent refining process.

FIG. 2

With reference to FIG. 2 of the drawings, a preferred embodiment of the process of the invention is disclosed as applied to a solvent refining process of the type illustrated in FIG. 1 and described hereinabove.

As in FIG. 1 the extract mixture is withdrawn from the bottom of extraction tower 6 through line 8 and passed in succession through heat exchangers 10, 11 and 101 which serve to preheat the extract mixture and to vaporize the solvent partly and is introduced into low pressure flash tower 12, suitably maintained at a pressure in the range of 0.1 to 1 bar wherein solvent vapors are separated partly from the extract mixture. Solvent vapors separated from the extract flash tower 12 are discharged through line 14 to heat exchanger 10 wherein they are partly condensed by indirect heat exchange with cold extract mixture from extraction tower 6 thereby preheating the extract mixture prior to introduction to flash tower 12. The solvent is further condensed in cooler 16 and passed through line 17 to solvent purification and storage system 68.

Extract mixture, from which part of the solvent has been removed, is withdrawn from the bottom of flash tower 12 by pump 19 and passed through heat exchanger 102 and heater 21 to high pressure flash tower 24 via line 22.

A further amount of solvent is separated from the extract in high pressure flash tower 24 suitably maintained at a pressure in the range of 4.0 to 10.0 bar.

Solvent vapors from flash tower 24 are passed through heat exchangers 114 and 102 and then through heat exchanger 11 for indirect heat exchange with extract mixture from the bottom of flash towers 24 and 12 and extraction tower 6 respectively. The heat exchange serving to condense the solvent vapors, subcool the condensed solvent and preheat the various extract mixtures. Following the condensation and cooling of the solvent vapors by heat exchange, the condensed solvent is passed through line 17 to solvent purification and storage system 68 for re-use in the process.

In accordance with the process of this invention, an extract mixture, still containing a considerable amount of solvent, is withdrawn from the bottom of high pressure flash tower 24 through line 112, pressure reducing valve 113 and heat exchanger 114 to a medium pressure flash tower 115 wherein additional solvent is recovered from the extract mixture.

By pressure reducing in valve 113 the temperature of the extract mix will drop well below the condensation temperature of the high pressure vapors from flash tower 24. The condensing heat of the high pressure vapors serve in heat exchanger 114 to evaporate solvent from the depressurized extract mix.

Medium pressure flash tower 115 is maintained at a pressure between that of low pressure tower 12 and high pressure tower 24, suitably at a pressure in the range of 1 to 4 bar.

Medium pressure flash tower 115 is similar in construction to flash towers 12 and 24 and is provided with reflux from line 116. Vaporized solvent is taken overhead from flash tower 115 through line 117 and heat exchanger 101 and then through heat exchanger 11 for indirect heat exchange with extract mixture from the extraction tower 6 and is delivered by line 17 together with solvent from the flash towers 12 and 24 to solvent purification and storage system 68.

The hydrocarbon oil extract, still containing some solvent, is withdrawn from the bottom of medium pressure flash tower 115 through line 119 to the extract recovery system comprising vacuum flash tower 32 as in the conventional extract recovery system illustrated in FIG. 1.

Extract from the lower portion of vacuum tower 32 is passed through line 40 to stripper 41 wherein it is stripped of its final traces of solvent by means of inert gas or steam. The stripped extract, containing less than about 50 parts per million solvent, e.g. furfural, N-methyl-2-pyrrolidone, or phenol, is withdrawn from the bottom of stripper 41 and discharged from the system by pump 44 through line 45 as a product of the process.

Stripping medium and solvent vapors are discharged from the upper part of stripping column 41 through line 46 and passed to solvent purification and storage system 68.

Raffinate mixture taken overhead from extraction tower 6 via line 9 is passed to raffinate solvent recovery 58 comprising a vacuum flash tower and a raffinate stripper.

Solvent vapors separated from the raffinate mixture in the flash tower of system 58 are taken overhead through line 34 and passed, together with the solvent vapors from the top of vacuum flash tower 32 to solvent purification and storage system 68.

Stripping medium and solvent vapors from the raffinate stripper of system 58 are taken overhead through line 46 and passed together with overheads from extract stripper 41 to solvent purification and storage system 68.

Raffinate, substantially free from solvent, is withdrawn as a product of the process from the bottom of the raffinate stripper and discharged through line 65 as the refined oil products of the process.

It will be evident from a comparison of FIGS. 1 and 2 above that the process of the present invention employs an additional intermediate pressure flash vaporization step following the usual high pressure flash vaporization step for the recovery of the solvent from the extract. This novel sequence of flash separation steps results in a relatively large saving in the energy requirements of the process as compared with a conventional process as illustrated in FIG. 1.

Each of the three flash towers 12, 24 and 115 in FIG. 2 will separate approximately $\frac{1}{3}$ of the total solvent contained in the extract mixture from the bottom of extractor 6 neglecting the solvent recovered in the vacuum flash tower 32 and stripper 41.

Heater 21, as the only heat supply source, transfers heat to the extract mixture from the bottom of flash tower 12, still containing about $\frac{2}{3}$ of the total solvent and serves to evaporate another $\frac{1}{3}$ of the total solvent at elevated pressure. The condensing heat of the high pressure vapors is transferred by exchanger 114 to the extract mixture from the bottom of flash tower 24, containing e.g. $\frac{1}{3}$ of the total solvent, to evaporate the last $\frac{1}{3}$ of the total solvent. The driving force for the evaporation in exchanger 114 is the positive temperature difference between the condensing vapors from flash tower 24 at high pressure and the flash temperature of the extract mixture entering the flash tower 115 at medium pressure. The condensing heat of the medium pressure vapors from flash tower 115, i.e. about $\frac{1}{3}$ of the total solvent is transferred by exchanger 101 to the extract mix from the bottom of extractor 6, containing all the solvent, to evaporate $\frac{1}{3}$ of the total solvent. The driving force for the evaporation in exchanger 101 is the positive temperature difference between the condensing vapors from flash tower at medium pressure and the flash temperature of the extract mix entering the flash tower 12 at low pressure.

However, part of the low pressure vapors are condensed by preheating the extract mix from the bottom of the extractor 6 by heat exchanger 10 to a temperature suitably below the boiling temperature of the extract mixture at the pressure in flash tower 12. The degree of condensing of the low pressure vapors depends on the temperature of the extract mix leaving the extractor 6.

The low pressure vapors will be finally condensed in cooler 16.

It is obvious that the low and high pressure flash tower 12 and 24 in FIG. 1 will each separate approximately $\frac{1}{2}$ of the solvent vapors of the total solvent contained in the extract mixture from the bottom of extractor 6.

Since heater 21 in FIG. 1 has to evaporate $\frac{1}{2}$ of the total solvent instead of $\frac{1}{3}$ as in FIG. 2, the relative saving of heat duty for heater 21 in FIG. 2 is approximately $(\frac{1}{2}-\frac{1}{3})/\frac{1}{2}=\frac{1}{3}$, equal 33.3 percent.

The process of FIG. 2 is applicable for lube oil refining with the solvents furfural, N-methyl-2-pyrrolidone and phenol and for lube oil dewaxing with the typical dewaxing solvents.

We claim:

1. In a process for treating a mineral oil stock with a selective solvent to separate components of different chemical nature, wherein solvent is recovered from the solvent-rich product phase by subjecting said product phase to sequential flash evaporation in a low pressure first evaporation stage followed by heating the unvaporized portion of the product phase from said first stage and flash vaporization in a high pressure second evaporation stage and finally by vacuum flash evaporation and stripping of residual solvent from said product phase at subatmospheric pressure, the improvement which comprises subjecting the unvaporized portion of the product phase from said second evaporation stage to flash evaporation in an additional intermediate pressure evaporation stage following the high-pressure stage at an operating pressure between the pressure of the low pressure stage and the pressure of the high-pressure stage, heat from an external source is supplied to said high pressure evaporation stage, and all of the heat for evaporation in said intermediate pressure evaporation stage is supplied as heat of condensation from condensing vapors of said high pressure evaporation stage.

2. A process according to claim 1, wherein the solvent-rich feed for the sequential evaporation stages is the extract of a solvent extraction of mineral oils.

3. A process according to claim 1, wherein the solvent-rich feed for the sequential evaporation stages is the mixture of wax and solvent or the mixture of dewaxed oil and solvent from a solvent dewaxing process.

4. A process according to claim 1 wherein the pressure in said first evaporation stage is within the range of 0.1 to 1 bar, the pressure in said high pressure evaporation stage is within the range of 4 to 10 bar, and the pressure in said intermediate pressure evaporation stage is within the range of 1 to 4 bar.

5. A process according to claim 1 wherein heat for evaporation of solvent in said first evaporation stage is supplied as heat of condensation from condensing vapors of said first evaporation stage and from said additional evaporation stage.

* * * * *